US011729558B2

(12) United States Patent
Shith et al.

(10) Patent No.: US 11,729,558 B2
(45) Date of Patent: Aug. 15, 2023

(54) HEARING DEVICE

(71) Applicant: Sivantos Pte. Ltd., Singapore (SG)

(72) Inventors: Muhammad Shahid Bin Shith, Singapore (SG); Thai Wee Ang, Singapore (SG); Lit Song Glen Ding, Singapore (SG); Holger Kral, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 273 days.

(21) Appl. No.: 17/243,846

(22) Filed: Apr. 29, 2021

(65) Prior Publication Data

US 2021/0345049 A1 Nov. 4, 2021

(30) Foreign Application Priority Data

Apr. 29, 2020 (DE) ..... 102020205439.8

(51) Int. Cl.
*H04R 25/00* (2006.01)
*H01R 13/631* (2006.01)
*H01R 13/52* (2006.01)

(52) U.S. Cl.
CPC ..... *H04R 25/556* (2013.01); *H01R 13/5219* (2013.01); *H01R 13/631* (2013.01)

(58) Field of Classification Search
CPC .... H04R 25/556; H04R 25/60; H04R 25/607; H04R 25/65; H04R 2225/57
See application file for complete search history.

(56) References Cited

U.S. PATENT DOCUMENTS

| | | | | |
|---|---|---|---|---|
| 4,945,569 | A | 7/1990 | Kulman | |
| 8,867,769 | B2 | 10/2014 | Naumann et al. | |
| 9,247,360 | B2 | 1/2016 | Barth et al. | |
| 10,567,892 | B2 | 2/2020 | Moller et al. | |
| 10,715,938 | B2 | 7/2020 | Kirchhoff et al. | |
| 2007/0009130 | A1* | 1/2007 | Feeley | H04R 25/607 381/330 |
| 2012/0014549 | A1 | 1/2012 | Higgins et al. | |

(Continued)

FOREIGN PATENT DOCUMENTS

| | | | |
|---|---|---|---|
| CN | 102763434 | A | 10/2012 |
| CN | 106233748 | A | 12/2016 |

(Continued)

*Primary Examiner* — Mark Fischer
(74) *Attorney, Agent, or Firm* — Laurence A. Greenberg; Werner H. Stemer; Ralph E. Locher

(57) ABSTRACT

A hearing device includes a housing elongated along a longitudinal axis, having an oval cross section, and configured to house electrical components. A loudspeaker disposed outside the housing in an intended wearing state of the hearing device is interconnected with at least a part of the electrical components. A plug connector is connected to the loudspeaker and carries at least six contact elements for interconnecting the loudspeaker with corresponding electrical components. A plug connector receptacle for receiving the plug connector interconnects the contact elements. The plug connector receptacle is disposed in a surface of the housing oriented toward a lower side in the intended wearing state. The plug connector and the plug connector receptacle define a plug-in direction extending from a front side to a rear side in the intended wearing state.

12 Claims, 5 Drawing Sheets

(56) References Cited

U.S. PATENT DOCUMENTS

| | | | | |
|---|---|---|---|---|
| 2016/0381472 | A1* | 12/2016 | Feeley | H04R 25/607 381/322 |
| 2017/0034611 | A1 | 2/2017 | Maruyama | |
| 2017/0289711 | A1* | 10/2017 | Maas | H04R 25/60 |
| 2019/0200145 | A1 | 6/2019 | Kirchhoff et al. | |
| 2019/0281396 | A1 | 9/2019 | Moller et al. | |
| 2020/0389741 | A1 | 12/2020 | Agac | |

FOREIGN PATENT DOCUMENTS

| | | | |
|---|---|---|---|
| DE | 202013000547 | U1 | 2/2013 |
| DE | 102013225429 | A1 | 6/2015 |
| DE | 102017128117 | A1 | 5/2019 |
| EP | 0326513 | A2 | 8/1989 |
| EP | 2456235 | A1 | 5/2012 |
| EP | 3503587 | A1 | 6/2019 |
| EP | 3537731 | A1 | 9/2019 |

* cited by examiner

HEARING DEVICE

CROSS-REFERENCE TO RELATED APPLICATION

This application claims the priority, under 35 U.S.C. § 119, of German Patent Application DE 10 2020 205 439.8, filed Apr. 29, 2020; the prior application is herewith incorporated by reference in its entirety.

BACKGROUND OF THE INVENTION

Field of the Invention

The invention relates to a hearing device, in particular, a hearing aid device.

Hearing devices are typically used to output an audio signal to aid the sense of hearing of the wearer of the hearing device. The output takes place by using an output transducer, usually acoustically through airborne sound by using a loudspeaker (also referred to as a "receiver"). Such hearing devices are frequently used as so-called hearing aid devices (referred to herein as hearing aids for short). For that purpose, the hearing devices normally include an acoustic input transducer (in particular, a microphone) and a signal processor, which is configured to process the input signal (also: microphone signal) generated by the input transducer from the ambient sound with an application of at least one typically user-specifically stored signal processing algorithm, in such a way that a hearing loss of the wearer of the hearing device is at least partially compensated for. In particular, in the case of a hearing aid device, the output transducer can, in addition to a loudspeaker, alternatively also be a so-called bone vibrator or a cochlea implant, which are configured for mechanical or electrical coupling of the sound signal into the sense of hearing of the wearer. The term hearing devices also additionally includes, in particular devices, e.g., so-called tinnitus maskers, headsets, headphones, and the like.

Hearing devices, in particular hearing aids, are generally used in the form of devices to be worn behind the ear (also referred to as "BTE") or in the ear (also referred to as "ITE"). BTEs can in turn be differentiated into devices which have the loudspeaker in the BTE housing, and those devices which have the loudspeaker externally, in particular, intended to be worn in the auditory canal. The latter are frequently also referred to as "RIC" ("receiver in canal") hearing aids. A connecting cable is known to be required in that case between the electrical components (for example the respective microphone, preferably a signal processor which contains the above-mentioned signal processing algorithm) disposed in the BTE housing and the loudspeaker. The connecting cable is usually coupled in the region of the "tip" of the generally roughly banana-shaped BTE housing to the housing. A corresponding connector is often constructed in such a way that, in the intended wearing state of the hearing aid, microphones oriented forward are not concealed. Moreover, however, the most captive possible connection, i.e., a connection which is stable and resistant to unintended detaching, is also required between the connecting cable and the BTE housing.

BRIEF SUMMARY OF THE INVENTION

It is accordingly an object of the invention to provide a hearing device, which overcomes the hereinafore-mentioned disadvantages of the heretofore-known devices of this general type and which provides an improved connection between an external loudspeaker and a housing of a hearing device.

With the foregoing and other objects in view there is provided, in accordance with the invention, a hearing device comprising a housing, which is stretched or elongated along a longitudinal axis, is formed with an oval cross section, and is configured for housing electrical components of the hearing device. Furthermore, the hearing device includes a loudspeaker, which is disposed outside the housing in the intended wearing state of the hearing device and is interconnected with at least a part of the electrical components. Moreover, the hearing device includes a plug connector which is connected to the loudspeaker, in particular, by using a loudspeaker connecting cable and which carries at least six contact elements for interconnecting the loudspeaker with the corresponding electrical components. Furthermore, the hearing device includes a plug connector receptacle for receiving the plug connector and interconnecting the respective contact elements. This plug connector receptacle is disposed in this case in a surface of the housing oriented toward the lower side in the intended wearing state. The plug connector and the plug connector receptacle are additionally constructed in such a way that a plug-in direction extends from a front side to a rear side in the intended wearing state.

Advantageous embodiments and refinements of the invention, which are partially inventive alone, are described in the dependent claims and the following description.

The electrical components preferably include at least one microphone and one signal processor for processing signals output on the part of the respective microphone. The hearing device optionally also includes as an (in particular further) electrical component, a preferably rechargeable battery unit, also referred to as a battery pack. The battery unit preferably in turn includes a charging electronics unit for controlling and monitoring a discharging or charging procedure.

Since the plug connector receptacle is disposed in the "lower side" of the housing, the microphone or at least one of multiple microphones having a correspondingly associated microphone opening, can be offset as far as possible toward the "tip" of the housing facing forward in the intended wearing state.

The housing, which is oval in cross section, is preferably formed approximately rectangularly having comparatively strongly rounded corners.

The hearing device preferably forms a hearing aid device, also referred to for short as a "hearing aid." In particular, the hearing device thus forms an RIC hearing aid or also an RIC-BTE, since the above-described housing is preferably intended to be worn behind the ear. In contrast, the external loudspeaker is to be worn in the ear, preferably in the auditory canal, in the intended wearing state.

In one expedient embodiment, the plug connector receptacle is countersunk in the surface of the housing oriented toward the lower side, specifically preferably in such a way that the plug connector is withdrawn from view from a lateral direction in the intended plugged-in state. The plug connector is thus "invisible" in the intended wearing state, on one hand, but the flattest possible contact surface on the ear of the user is also advantageously formed, on the other hand.

In a further expedient embodiment, the plug connector and the plug connector receptacle are constructed as complementary to one another and self-aligning. In particular, both have an asymmetrical, preferably partially flattened oval profile. The plug connector is thus uniquely positionable in relation to the housing during the installation in a simple manner and incorrect contacting of the contact elements is avoided.

In one preferred embodiment, the plug connector and the plug connector receptacle each include a part of a retaining device automatically actuatable in the plug-in direction. Locking of the plug connector in the housing by an additional measure, for example by a locking pin, which is inserted transversely through the housing, can thus advantageously be omitted.

In particular, the plug connector includes a groove as part of the retaining device and the plug connector receptacle includes a wire spring (which is preferably formed like a C ring). This wire spring engages in the intended coupling state in the groove, so that a reversibly active form-locking against inadvertent withdrawal of the plug connector is formed.

In one expedient embodiment, the plug connector includes an injection-molded main body made of a first plastic. A circumferential seal made of a second plastic is molded on this main body and is preferably connected thereto in a materially bonded manner. The seal is optionally molded on in a multicomponent injection molding method. The seal is preferably formed by so-called "liquid injection molding" with an introduction in particular of a liquid silicone rubber (abbreviated: "LSR"). Manual positioning of the seal during the installation, which is frequently difficult and complex due to the generally comparatively small dimensions of hearing aids (and thus also of the plug connector), can thus be omitted.

In a further expedient embodiment (alternatively or preferably additionally to the above-described seal), the plug connector includes an injection-molded main body (in particular, the one described above). In the intended coupling state, this main body is disposed obliquely in relation to the surface of the housing oriented toward the lower side. An end face of the main body which faces toward the loudspeaker and from which the loudspeaker connecting cable exits, is thus placed obliquely in relation to a cable exit direction of the loudspeaker connecting cable, following the surface of the housing oriented toward the lower side. In other words, this end face of the plug connector is aligned obliquely, so that, in the intended coupling state, the end face is disposed substantially (i.e., with minor deviations) parallel to the downwardly oriented surface and preferably also lying in its plane. An "optimized length" of the plug connector thus results, so that a lever action, which occurs due to excess transverse tension, which is not provided upon intended handling, on the loudspeaker connecting cable at a "pivot point," can be reduced. This pivot point represents the point at which the plug connector is in contact with the housing in such an impermissible handling case.

The plug connector, in particular its main body, is preferably only slightly larger in its cross section than the loudspeaker connecting cable, for example by up to a factor of two. The plug connector plugged into the plug connector receptacle thus only occupies little space on the housing, so that a particularly large amount of installation space is available on or in the housing for the positioning of the or of the respective microphone and the respectively associated microphone opening and/or the silhouette of the hearing device can be reduced in size.

In one advantageous embodiment, the plug connector includes a contact carrier in the form of a plate protruding on the end face (in particular, of the main body) facing away from the loudspeaker. The above-described contact elements are formed as contact surfaces on this plate and, in particular, are disposed so as to be distributed on both sides. This plate represents a comparatively stable device for contacting and is similar in the basic principle to a contact carrier of a USB 2.0 type A plug.

In one expedient embodiment, the plug connector receptacle includes spring contacts corresponding to each of the above-described contact surfaces for contacting.

In a further expedient embodiment, the plug connector includes a coding, in particular a color coding, to indicate the side associated with the corresponding ear of a user. This is advantageous, in particular, for the case that the user uses one hearing device, for example a binaural hearing aid system, for each ear. The situation can optionally exist in this case that a different loudspeaker is used for each ear. At least the loudspeaker connecting cable is regularly bent for the most invisible possible and non-disturbing connection between the housing to be worn behind the ear and the loudspeaker. The coding enables a reduction of the risk of usage on reversed sides. The plug connector receptacle preferably also includes a corresponding coding. For example, the plug connector for the right ear is colored in a first color, for example blue, and that for the left ear in a second color, for example red. The plug connector receptacle is, in particular, colored correspondingly, so that a unique assignment is possible.

In a further expedient embodiment, at least the plug connector receptacle includes contact elements which are configured and provided (preferably in addition to the above-described interconnection of the loudspeaker) for charging the rechargeable battery unit, and/or for data exchange with the signal processor. The signal processor is generally configured to execute at least one signal processing algorithm for processing the (microphone) signals. This (or the respective) signal processing algorithm is advantageously parameterizable in a user-specific manner in this case, which in the present embodiment can expediently also take place through the plug connector receptacle while saving an additional interface. In this case, the loudspeaker including the associated cable is preferably removed for the parameterization and a data cable having a comparable plug connector is connected to the plug connector receptacle.

Other features which are considered as characteristic for the invention are set forth in the appended claims.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
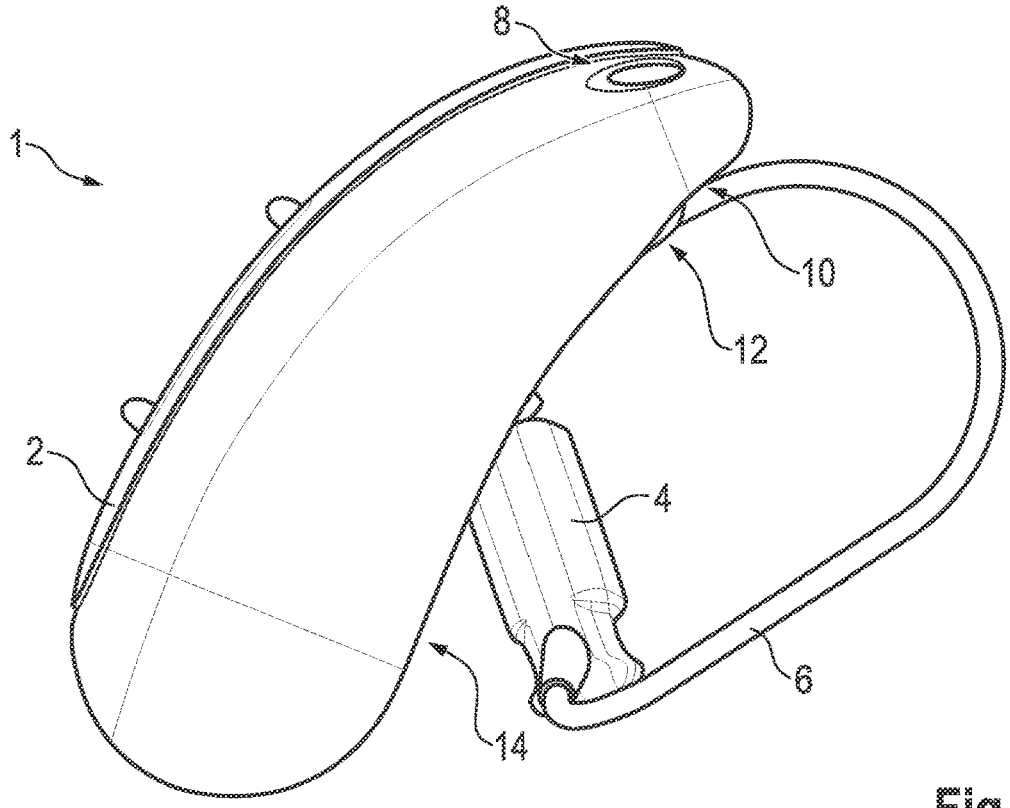
FIG. 1 is a diagrammatic, side perspective view of a hearing device having an external loudspeaker.

Referring now in detail to the figures of the drawings, in which parts corresponding to one another are always provided with the same reference signs, and first, particularly, to FIG. 1 thereof, there is seen a diagrammatic illustration of a hearing device in the form of a hearing aid device, which is referred to herein for short as a "hearing aid 1." The hearing aid 1 has a housing 2 which conceals electronics, is to be worn behind the ear ("BTE") and includes an external loudspeaker 4. The loudspeaker 4 is to be worn at least partially in the auditory canal of a user in the intended wearing state and is therefore also referred to as "receiver in canal" ("RIC"). In the intended coupling state (see FIG. 1), the loudspeaker 4 is interconnected with the housing 2, specifically with the electronics disposed therein, for example a signal processor, by using a loudspeaker connecting cable (referred to herein as a "cable 6" for short).

In order to have sufficient space on the housing 2 for a microphone opening 8 facing forward in as straight a line as possible (i.e., along a horizontal) in the intended wearing state, a plug connector receptacle (referred to herein as a "socket 10" for short) for receiving a plug connector 12 of the cable 6 is disposed on a surface 14 facing downward in the intended wearing state of the hearing aid 1. In order to conceal the plugged-in plug connector 12 as much as possible from the view of third parties and/or to avoid skin irritation due to protruding edges, the socket 10 is incorporated into the above-mentioned surface 14, i.e., countersunk. Specifically, the socket 10 is countersunk in such a way that, in the plugged-in state (see FIG. 1), the plug connector 12 protrudes only negligibly or not at all above the surface 14.

Figure 2:
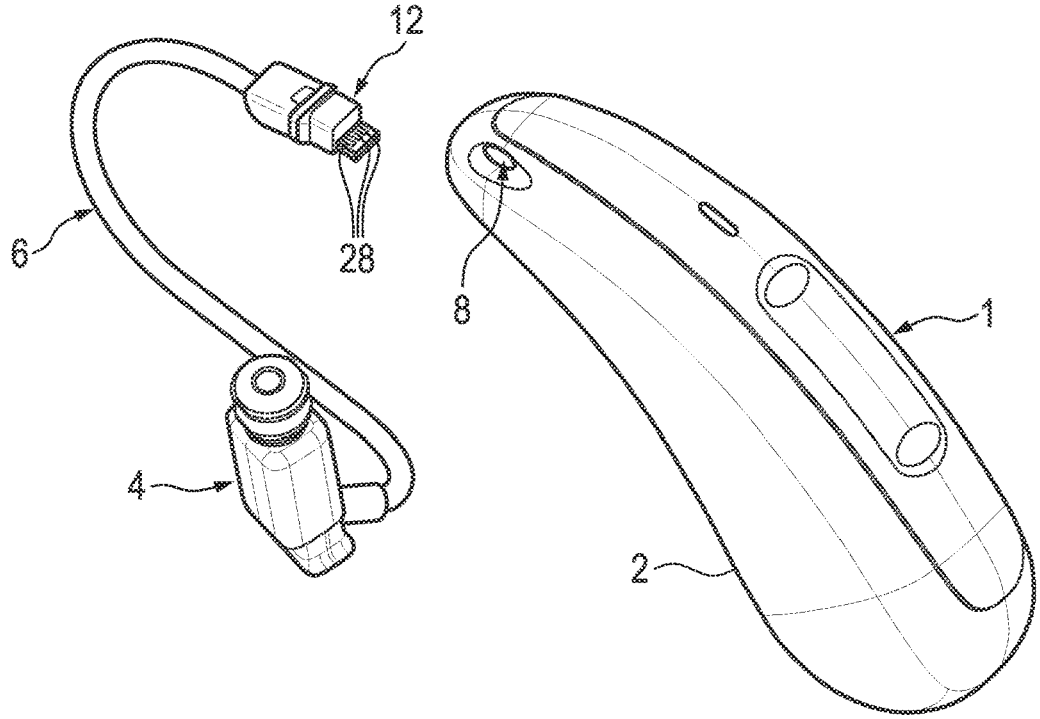
FIG. 2 is a perspective view of the hearing device with a decoupled loudspeaker.
Figure 3:
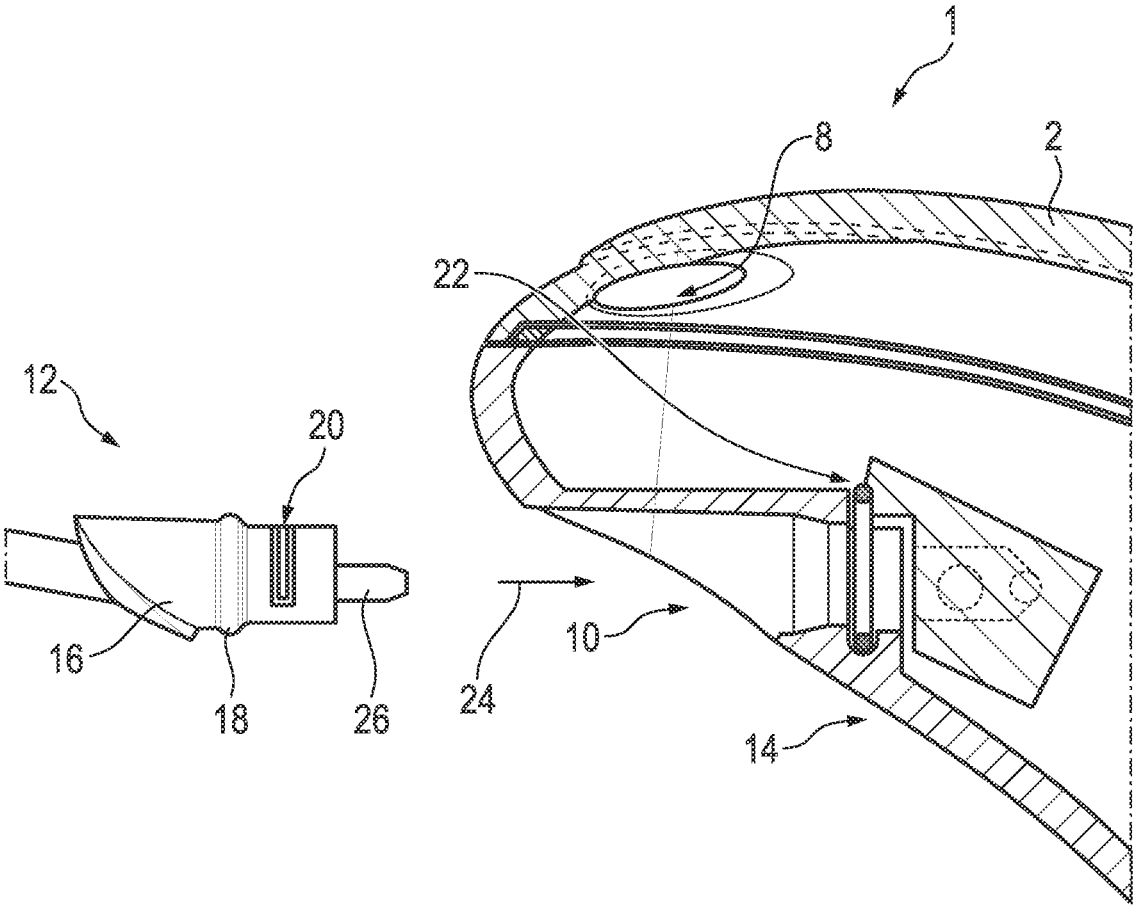
FIG. 3 is a fragmentary, partially sectional view of a plug connector for connecting the loudspeaker to a plug connector receptacle of a housing of the hearing device.

In FIGS. 2 and 3, the plug connector 12 is shown removed from the socket 10. It can be seen in this case that the plug connector 12 includes a main body 16, which is injection molded from a first thermoplastic. A circumferential seal 18 made of liquid silicone rubber is injection molded onto this main body 16. In addition, the main body 16 includes a groove 20 as part of a retaining device.

A bow-shaped wire spring 22 is inserted in the socket 10 as a further part of the retaining device. The wire spring 22 is first tensioned radially outward when the main body 16 is plugged in and subsequently "snaps" into the groove 20. The plug connector 12 can thus be held in the socket 10, without further locking elements being required.

The plug connector 12 and the socket 10 are constructed in this case in such a way that the coupling takes place by way of a linear insertion movement along a plug-in direction 24.

In order to provide contacting, the plug connector 12 includes a plate 26, around which the main body 16 is preferably injection molded and which carries a plurality, three herein in each case, of contact elements 28 on an upper side and on a lower side. The contact elements 28 are disposed as planar elements in the surface of the plate 26. Contact springs corresponding to the contact elements 28 are disposed in a manner not shown in greater detail in the socket 10.

Figure 4:
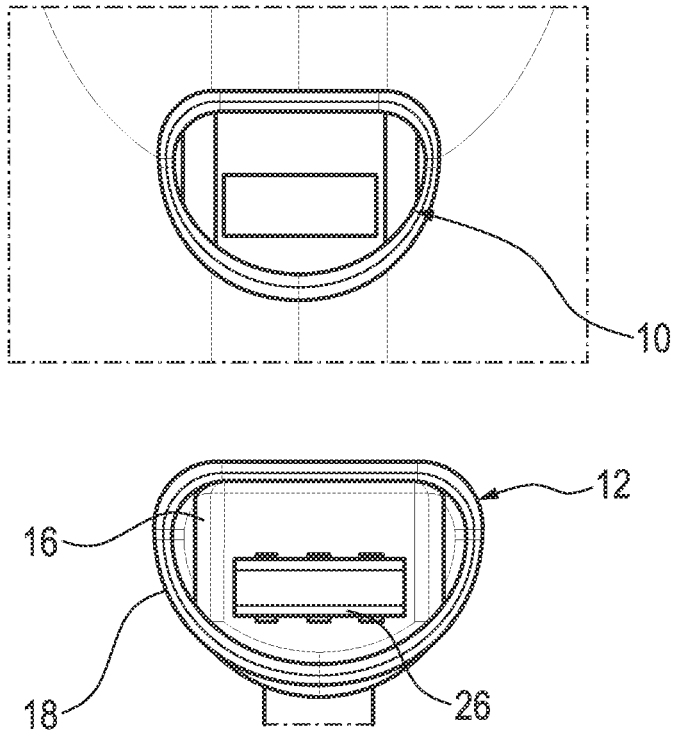
FIG. 4 is a detailed front-elevational view of the plug connector and the plug connector receptacle.
Figure 5:
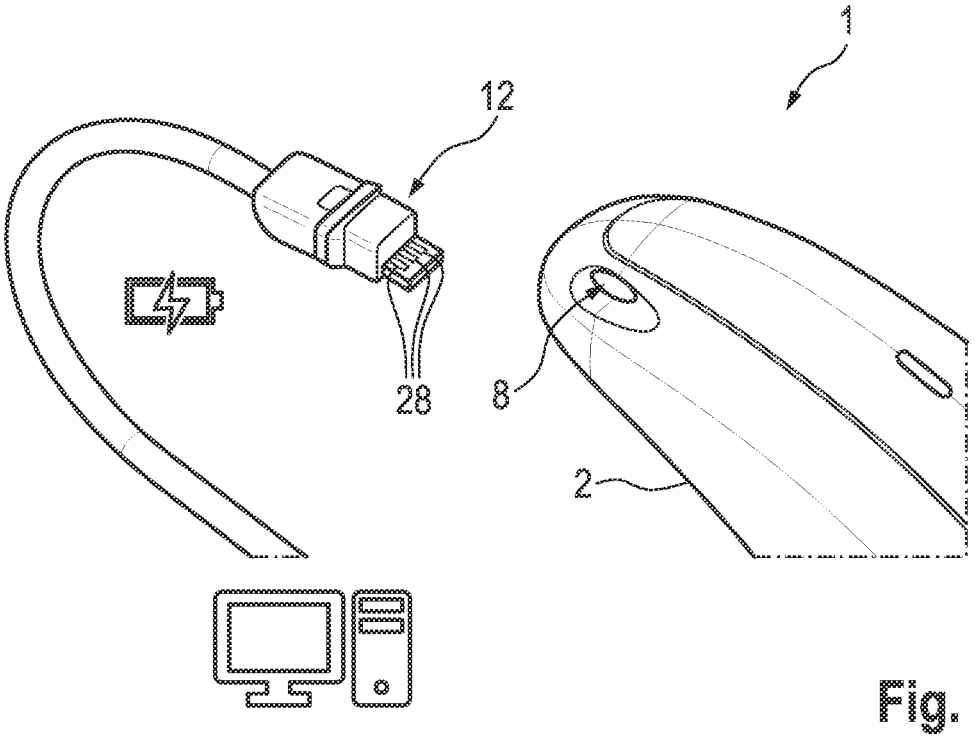
FIG. 5 is a fragmentary, perspective view showing a further intended use of the plug connector receptacle.
Figure 6:
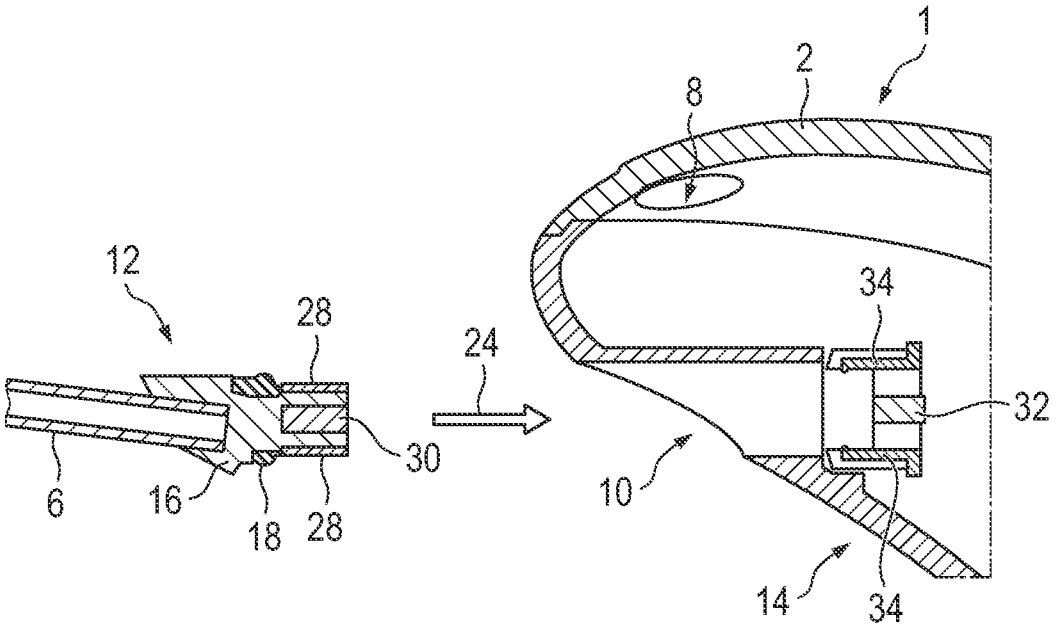
FIGS. 6 and 7 are sectional views according to FIG. 3 of a further exemplary embodiment of the plug connector and the plug connector receptacle in a disassembled state and an assembled state.
Figure 7:
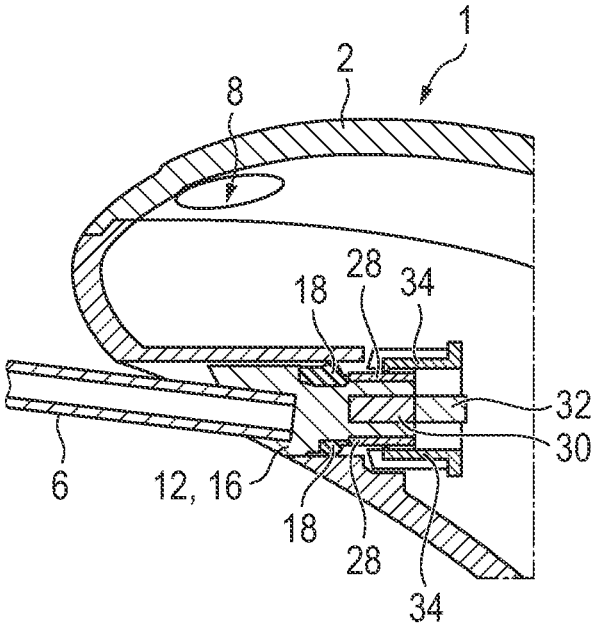
Figure 8:
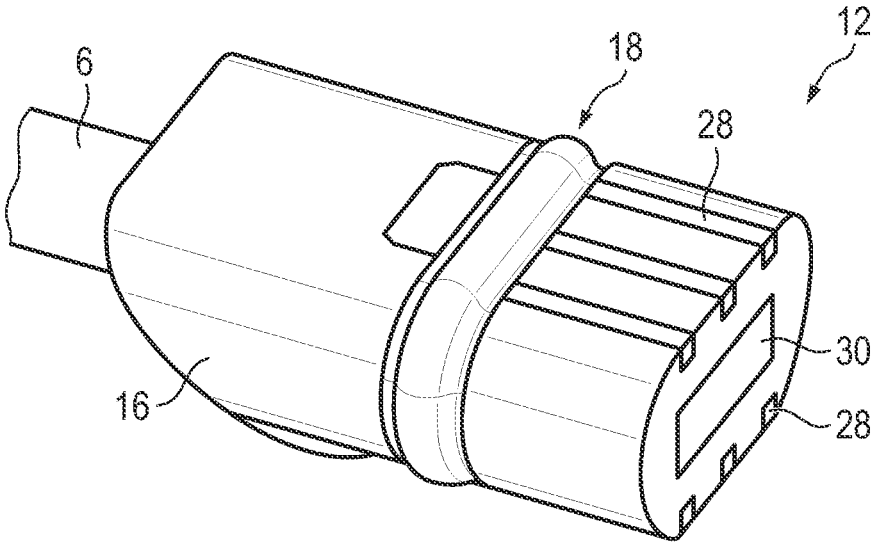
FIG. 8 is a perspective view of the plug connector according to FIG. 6.

As can be seen from FIG. 4, the plug connector 12 and the socket 10 have profiles complementary to one another, specifically asymmetrical ovals having a flattened (upper) side. A unique alignment is thus enabled during the assembly.

FIG. 4 shows a further use of the socket 10. In this case, the plug connector 12 is used to connect, for example, a permanently installed, rechargeable battery of the hearing aid 1 to an energy source. Additionally (or alternatively), the plug connector 12 can also be used to couple a signal processor of the hearing aid 1 to a programming unit, specifically a computer, on which adaptation software is implemented to be executable.

A further invention, which is also an invention on its own and which in particular represents an additional or alternative embodiment to the above-described retaining device, relates to:

A. A hearing device ("hearing aid 1"), comprising:
   - a housing 2, which is stretched or elongated along a longitudinal axis, is formed in an oval shape in cross section, and is configured to house electrical components of the hearing device,
   - a loudspeaker 4, which is disposed outside the housing 2 in the intended wearing state of the hearing device and is interconnected with at least a part of the electrical components,
   - a plug connector 12, which is connected to the loudspeaker 4 and which carries at least six contact elements 28 for interconnecting the loudspeaker (4) with the corresponding electrical components, and
   - a plug connector receptacle ("socket 10") for receiving the plug connector 12 and interconnecting the respective contact elements 28, in particular wherein the plug connector receptacle is disposed in a surface 14 of the housing 2 oriented toward the lower side in the intended wearing state, wherein the plug connector 12 and the plug connector receptacle are constructed in such a way that a plug-in direction 24 extends from a front side to a rear side in the intended wearing state, and wherein the plug connector 12 and the plug connector receptacle are configured for mutual magnetic retention. (The above-described retaining device is thus implemented in this case in particular by the magnetic attraction between plug connector 12 and plug connector receptacle.)

B. The hearing device according to A, wherein a magnet (30, 32), in particular a permanent magnet, is disposed in each case on both the plug connector 12 and also in the plug connector receptacle.

C. The hearing device according to A, wherein a permanent magnet (30, 32) is disposed on the plug connector 12 or in the plug connector receptacle and paramagnetic material is disposed in the plug connector receptacle or on the plug connector 12, respectively.

D. The hearing device according to A, B, and/or C, wherein the plug connector receptacle is countersunk in the surface 14 oriented toward the lower side, so that the plug connector 12 is withdrawn from view from a lateral direction in the intended plugged-in state.

E. The hearing device according to A, B, C, and/or D, wherein the plug connector 12 and the plug connector receptacle are formed complementary to one another and self-aligning, in particular having an asymmetrical, preferably partially flattened oval profile.

F. The hearing device according to A, B, C, D, and/or E, wherein the plug connector 12 includes an injection-molded main body 16 made of a first plastic and wherein a circumferential seal 18 is molded from a second plastic on the main body 16.

G. The hearing device according to A, B, C, D, E, and/or F, wherein the plug connector 12 includes an injection-molded main body 16 made of a first plastic, wherein the main body 16 is disposed in the intended coupling state obliquely to the surface 14 of the housing 2 oriented toward the lower side, and wherein an end face of the main body 16 which faces toward the loudspeaker 4 and from which a loudspeaker connecting cable 6 exits, is placed obliquely in relation to a cable exit direction of the loudspeaker connecting cable 6, following the surface 14 of the housing 2 oriented toward the lower side.

H. The hearing device according to A, B, C, D, E, F, and/or G, wherein the plug connector 12 includes a contact carrier (which is in particular formed in one piece with the main body 16), on which the contact elements 28 are formed as contact surfaces disposed on both sides, in particular wherein the magnet 30 is integrated, in particular injected, in the contact carrier, in particular wherein contact springs 34 corresponding to the contact elements 28 are disposed in the plug connector receptacle.

I. The hearing device according to A, B, C, D, E, F, G, and/or H, wherein the plug connector 12 is color-coded, in particular to be able to differentiate it in the context of a hearing device system formed therefrom and a further hearing device from a plug connector assigned to the other ear.

The subject matter of the invention is not restricted by the above-described exemplary embodiments. Rather, further embodiments of the invention can be derived by a person skilled in the art from the above description.

LIST OF REFERENCE SIGNS

1 hearing aid
2 housing
4 loudspeaker
6 cable
8 microphone opening
10 socket
12 plug connector
14 surface
16 main body
18 seal
20 groove
22 wire spring
24 plug-in direction
26 plate
28 contact element
30 magnet
32 magnet
34 contact spring

The invention claimed is:

1. A hearing device, comprising:

a housing elongated along a longitudinal axis, said housing having an oval cross section, said housing configured to house electrical components of the hearing device, and said housing having a front side, a rear side, a lower side and a surface oriented toward said lower side in an intended wearing state of the hearing device;

a loudspeaker disposed outside said housing in the intended wearing state, said loudspeaker configured to be interconnected with at least a part of the electrical components;

a plug connector connected to said loudspeaker, said plug connector carrying at least six contact elements for interconnecting said loudspeaker with corresponding electrical components;

a plug connector receptacle for receiving said plug connector and respectively interconnecting said contact elements, said plug connector receptacle disposed in said surface of said housing oriented toward said lower side; and said plug connector and said plug connector receptacle defining a plug-in direction extending from said front side to said rear side in the intended wearing state.

2. The hearing device according to claim 1, wherein said plug connector receptacle is countersunk in said surface oriented toward said lower side, causing said plug connector to be withdrawn from view from a lateral direction in the intended plugged-in state.

3. The hearing device according to claim 1, wherein said plug connector and said plug connector receptacle are complementary to one another and self-aligning.

4. The hearing device according to claim 3, wherein said plug connector and said plug connector receptacle are asymmetrical.

5. The hearing device according to claim 3, wherein said plug connector and said plug connector receptacle have a partially flattened oval profile.

6. The hearing device according to claim 1, wherein said plug connector and said plug connector receptacle each include a part of a retaining device being automatically actuatable in said plug-in direction.

7. The hearing device according to claim 6, wherein said plug connector has a groove, and said plug connector receptacle includes a wire spring engaging in said groove in an intended coupling state.

8. The hearing device according to claim 1, wherein said plug connector includes an injection-molded main body made of a first plastic, and a circumferential seal made of a second plastic is molded on said main body.

9. The hearing device according to claim 1, wherein said plug connector includes an injection-molded main body made of a first plastic, said main body is disposed obliquely relative to said surface oriented toward said lower side in an intended coupling state, said main body has an end face facing toward said loudspeaker, and a loudspeaker connecting cable exits from said end face and is placed obliquely relative to a cable exit direction of said loudspeaker connecting cable following said surface oriented toward said lower side.

10. The hearing device according to claim 9, wherein said main body has an end face facing away from said loudspeaker, said plug connector includes a contact carrier formed as a plate protruding on said end face facing away from said loudspeaker, and said contact elements are formed on said plate as contact surfaces disposed on both sides of said plate.

11. The hearing device according to claim 10, wherein said plug connector receptacle includes corresponding spring contacts for contacting each of said contact surfaces.

12. The hearing device according to claim 1, wherein said plug connector includes a coding or a color coding for indicating a side associated with a corresponding ear of a user.

* * * * *